US005319920A

United States Patent [19]

Taylor

[11] Patent Number: 5,319,920

[45] Date of Patent: Jun. 14, 1994

[54] LUBRICANT SUPPLY AND RETURN SYSTEM FOR THE CENTER BEARING ASSEMBLY AND THE REAR BEARING ASSEMBLY OF A MARINE OR INDUSTRIAL GAS TURBINE ENGINE

[75] Inventor: Stephen M. A. Taylor, Mason, Ohio

[73] Assignee: General Electric Company, Cincinnati, Ohio

[21] Appl. No.: 890,740

[22] Filed: May 28, 1992

[51] Int. Cl.[5] ..... F02C 7/06

[52] U.S. Cl. ..... 60/39.08; 184/6.11

[58] Field of Search ..... 60/39.08; 184/6, 6.11, 184/8

[56] References Cited

U.S. PATENT DOCUMENTS

| | | | |
|---|---|---|---|
| 1,795,297 | 3/1931 | Dirkes | 184/8 |
| 2,402,467 | 6/1946 | Thompson | 60/39.08 |
| 2,531,411 | 11/1950 | Davenport | 184/6.11 |
| 2,566,049 | 8/1951 | Williams | 60/39.08 |
| 2,571,166 | 10/1951 | Rossetto | 184/6.11 |
| 2,672,010 | 3/1954 | Newcomb | 60/39.08 |
| 2,791,090 | 5/1957 | Hooker | 60/39.08 |
| 2,996,146 | 8/1961 | Beam, Jr. et al. | 184/6.11 |
| 3,884,041 | 5/1975 | Zerlauth | 60/39.08 |
| 4,446,377 | 5/1984 | Kure-Jensen et al. | 60/39.08 |
| 4,891,934 | 1/1990 | Huelster | 184/6.11 |

FOREIGN PATENT DOCUMENTS

| | | | |
|---|---|---|---|
| 0702551 | 1/1965 | Canada | 184/6.11 |
| 0659569 | 10/1951 | United Kingdom | 184/6.11 |

*Primary Examiner*—Richard A. Bertsch
*Assistant Examiner*—Howard R. Richman
*Attorney, Agent, or Firm*—Jerome C. Squillaro; Charles L. Moore, Jr.

[57] ABSTRACT

A lubrication supply and return system for the center and rear bearing assemblies of a marine or industrial gas turbine engine. The supply line for both bearing assemblies and the return lines for the rear bearing assembly are mounted off-engine in an elongated tray which is supported by the engine and is capable of forward thermal expansion. The tray mounted supply line is connected to the supply pump and the center bearing assembly by flexible hoses. The tray supported return lines are attached to the scavenge pump by flexible hoses. The return lines from the center bearing assembly to the scavenge pump have flexible hose portions supported by the tray.

7 Claims, 5 Drawing Sheets

LUBRICANT SUPPLY AND RETURN SYSTEM FOR THE CENTER BEARING ASSEMBLY AND THE REAR BEARING ASSEMBLY OF A MARINE OR INDUSTRIAL GAS TURBINE ENGINE

TECHNICAL FIELD

The invention relates to a lubrication supply and return system for a marine or industrial gas turbine engine, and more particularly to such a system, a major portion of which is carried off-engine by a support tray.

BACKGROUND ART

The present invention is directed to improvements in the lubrication supply and return or scavenge system of marine or industrial gas turbine engines. The most common lubrication system in use today is of the dry sump type wherein lubricating oil is carried externally of the engine in a separate tank or reservoir. In a gas turbine engine, the bearing assemblies must be lubricated with oil, and heat from the engine parts must be absorbed and dissipated by the same oil. It is common practice to house the engine bearing assemblies in their own respective sumps. The major components of a dry sump lubrication system comprise a lubricating oil reservoir or tank, a supply pump for supplying lubricating oil from the reservoir to the bearing assembly sumps under pressure. A scavenge pump for removing lubricating oil from the bearing assembly sumps. The scavenge pump causes the return lubrication oil to pass through a heat exchange assembly, on its way to the tank or reservoir. The heat exchange assembly often puts the return lubrication oil in heat exchange with the jet fuel used by the engine. Fuel, on its way to the combustor, enters and passes through the heat exchanger at a much greater flow rate than the oil, so that large quantities of heat are absorbed from the oil by the fuel. Appropriate filter means are also included in the system to remove contaminants from the oil.

The system also includes the necessary lubrication and scavenge lines. Prior art practice has been to secure the lubrication and scavenge lines by clamps and brackets to the engine cases, frames, ducts and the like. The routing of these lines has been affected by the routing of other systems similarly mounted to the engine. Routing conflicts had to be resolved. A change in the other systems often required changes in the routing of the lubrication and scavenge lines. Since the lubrication and scavenge lines run from the pumps to the turbine rear frame, almost every change in the engine impacted the lubrication and scavenge system in some way. By the same token, location of the lubrication and scavenge system on-engine, also restricted the routing of other systems.

The routing of the lubrication and scavenge system on-engine also posed thermal stress problems. The lubrication and scavenge lines passed over the hot section of the engine and routing was complicated by thermal loops. In addition, high stresses sometimes required the use of more costly materials such as nickel-ferrous alloys.

When it was necessary to remove portions of the engine casings, this often required time consuming dismantling of portions at least of the lubrication and scavenge system.

The present invention is based upon the discovery that the above-noted problems can be eliminated if the lubricant and scavenge lines from the supply and scavenge pumps can be supported off-engine. To this end, those supply and scavenge lines which extend aft to the rear bearing assembly sump are mounted on a longitudinally extending tray. These lines are straight and rigid and are connected at the aft end of the tray to the appropriate ones of the rear bearing assembly sump supply and scavenge tubes. The tray mounted supply line is connected by a flexible hose to the output of the supply pump and by another flexible hose to the supply tube of the center bearing assembly sump. The two tray mounted scavenge lines from the rear bearing assembly sump are connected by flexible hoses to the scavenge pump. The two rigid center bearing assembly sump scavenge lines are connected by flexible hoses to the scavenge pump, the hoses being supported by a bracket on the forward end of the tray. The tray is so mounted on the engine as to be capable of thermal growth in the forward direction, which growth is additionally accommodated by the flexible hoses. In this way, the supply and scavenge lines of the lubrication system do not interfere with other systems mounted on the engine. Furthermore, the tray mounted scavenge and supply lines can be disconnected from the system by disconnecting seven tube connections. The tray, itself, can be removed by the removal of eight bolts. The thermal and dynamic properties of this arrangement are excellent with infinite life expectancy. The cost of the system is far less than on-engine routed systems. Assembly time is drastically reduced. Removal of casings from combustor section or the turbine section is greatly facilitated.

DISCLOSURE OF THE INVENTION

According to the invention, there is provided a lubrication and scavenge system for cooling and lubricating the center bearing assembly and the rear bearing assembly of a marine or industrial gas turbine engine. The center bearing and rear bearing assemblies are each surrounded by a sump having supply and scavenge tubes. A supply pump provides oil under pressure from a reservoir to the center bearing assembly sump and the rear bearing assembly sump. A scavenge pump withdraws oil from these sumps and causes the return oil to pass through a heat exchanging assembly prior to its return to the reservoir. The supply or lubricating line for the center bearing assembly sump and the rear bearing assembly sump is carried on an off-engine tray, as are the return or scavenge lines from the rear bearing assembly sump. The tray supported supply line is removably connected to the supply tube of the rear bearing assembly sump and is connected to the main pump and the supply tube of the center bearing assembly sump by flexible hoses. The tray supported scavenge lines are removably connected to the scavenge tubes of the rear bearing assembly sump, and to the scavenge pump by flexible hoses. The scavenge tubes of the central bearing assembly sump are connected by flexible hoses to the scavenge pump. Finally, the supply tube of the central bearing assembly sump is connected to a T-fitting in the tray mounted supply line by a flexible hose.

The tray is rectilinear and its aft end is rigidly affixed by a bracket to the aft flange of the turbine section of the engine. The forward end of the tray is attached to the aft flange of the compressor section by a flexible bracket assembly. The flexible bracket assembly and the above noted flexible hoses allow for forward thermal growth of the assembly.

DETAILED DESCRIPTION OF THE INVENTION

Figure 1:
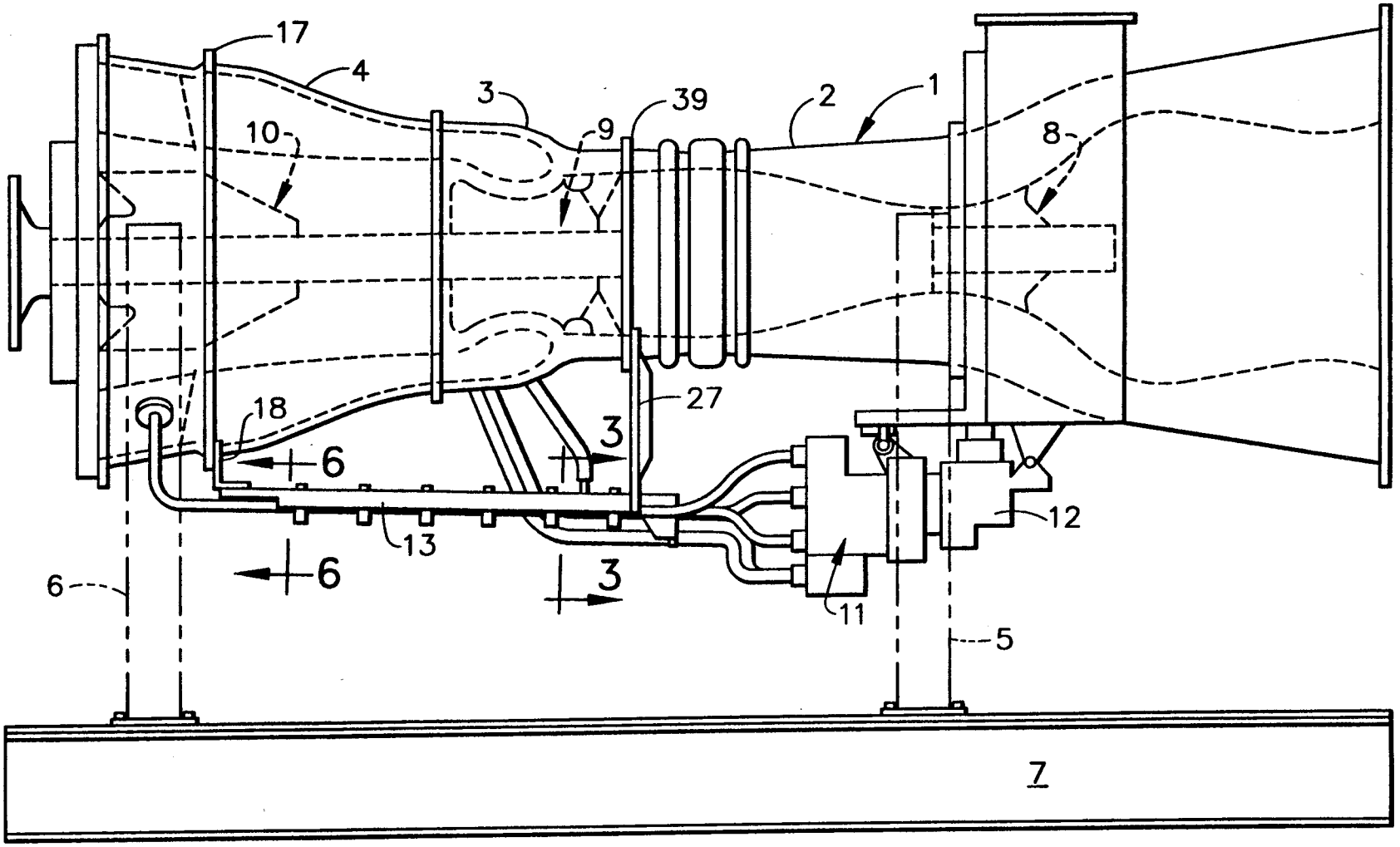
FIG. 1 is a simplified elevational view of a marine or industrial engine provided with a lubricating system for its central and rearward bearing assemblies, in accordance with the present invention.

Reference is first made to FIG. 1 wherein the exemplary marine or industrial gas turbine engine is illustrated in simplified fashion and is generally indicated at 1. The gas turbine engine comprises a compressor section 2, a combustor section 3 and a turbine section 4. The compressor section 2 contains a low pressure compressor and a high pressure compressor (not shown). Similarly, the turbine section 4 contains a high pressure turbine and a low pressure turbine (not shown). The engine 1 is supported by appropriate mounting means, two of which are shown in broken lines at 5 and 6. The supports 5 and 6 extend upwardly from a base assembly 7.

The engine has a forward bearing assembly generally indicated at broken lines at 8. A center bearing assembly is shown in broken lines and is generally indicated at 9, and a rear bearing assembly is shown in broken lines and is generally indicated at 10. The forward, center and rear bearing assemblies 8, 9 and 10 are primary elements requiring cooling and lubrication by the lubrication and scavenge system of the engine.

At the heart of the lubrication system is a supply and scavenge pump assembly. The supply and scavenge pump assembly 11 is driven by an accessory drive or gear box 12, as is well known in the art. The supply portion of the supply and scavenge pump assembly 11 provides oil under pressure to the sumps of bearing assemblies 8, 9 and 10, to cool and lubricate the bearings. The oil is provided from a tank or reservoir (not shown). The scavenge pump part of the supply and scavenge pump assembly 11 withdraws lubricating oil from the sump halves of the bearing assemblies 8, 9 and 10 and return it to the reservoir via an oil cooler or heat exchange device (not shown). The hot lubricating oil is placed in heat exchange with another fluid to reduce the temperature of the oil. As indicated above, the other fluid is frequently jet engine fuel which is preheated by this heat exchange prior to entry into the combustor. Foreign material is removed from the oil by filters which are located in both supply and scavenge lines.

Lubrication of front bearing assembly 8 is a separate system and does not constitute a part of the present invention. As a consequence, the present invention is directed primarily to the system for lubricating the central bearing assembly 9 and the rear bearing assembly 10.

There are many types and models of marine or industrial engines and the present invention is applicable to many such engines which demonstrate the problems set forth in the preamble of this specification. For purposes of an exemplary showing, the engine 1 is of the type manufactured by General Electric Company of Evandale, Ohio, under the designation LM 6000. In the illustration of FIG. 1, the engine 1 is greatly simplified and the various systems which are normally mounted on the exterior of the ducts, frames and casings of the compressor, combustor and turbine sections 2, 3 and 4, have been omitted for purposes of clarity. The same is true of FIG. 2.

Figure 2:
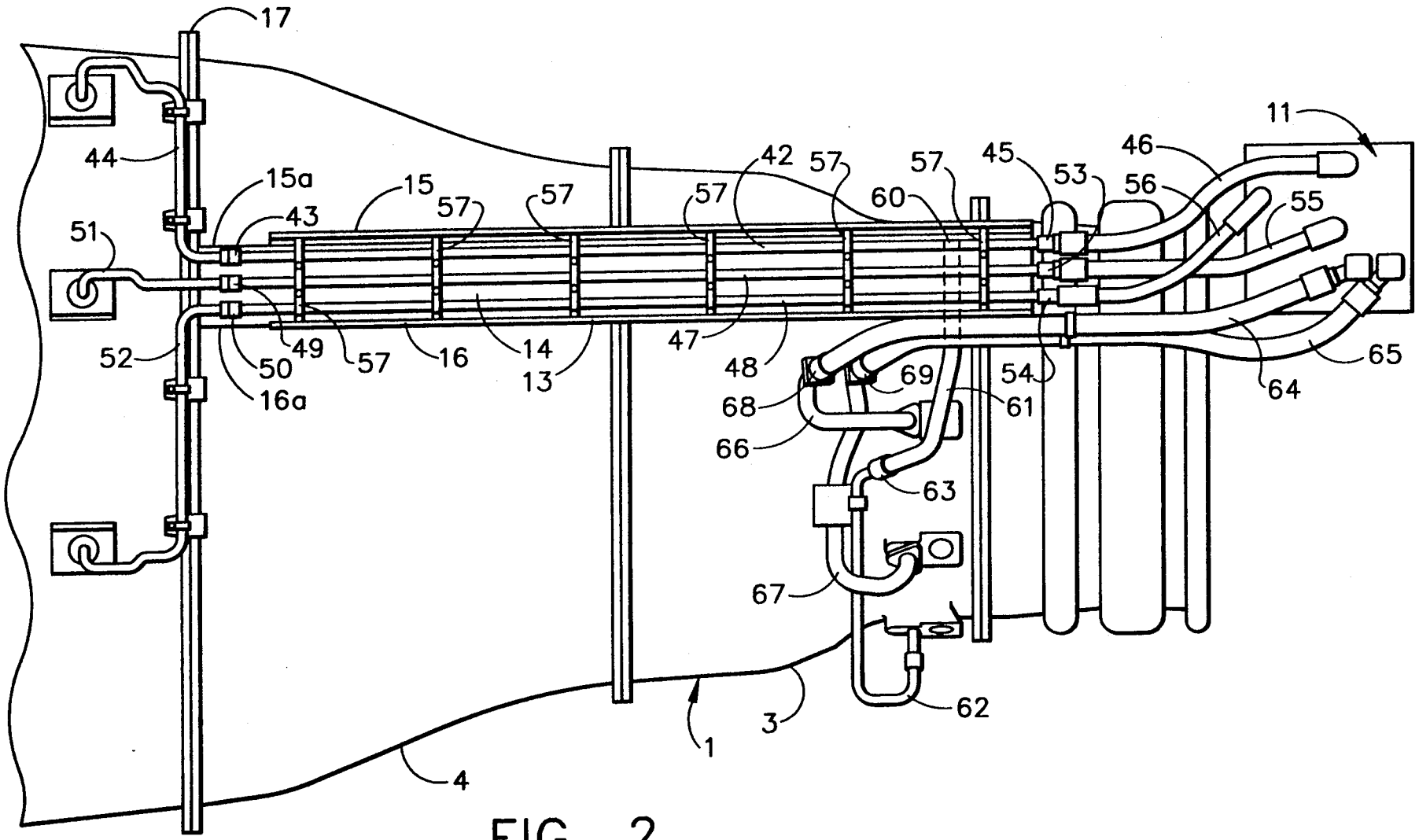
FIG. 2 is a fragmentary bottom view of the lubricating system of FIG. 1.

Turning first to FIGS. 1 and 2, the gas turbine engine 1 is provided with a substantially horizontal tray, generally indicated at 13. The tray 13 comprises and elongated, rectilinear member. The tray 13 has a planar support portion 14 and a pair of downwardly and outwardly depending side walls 15 and 16. Near the end of tray 13, the side walls 15 and 16 are notched, as at 15*a* and 16*a*.

Figure 6:
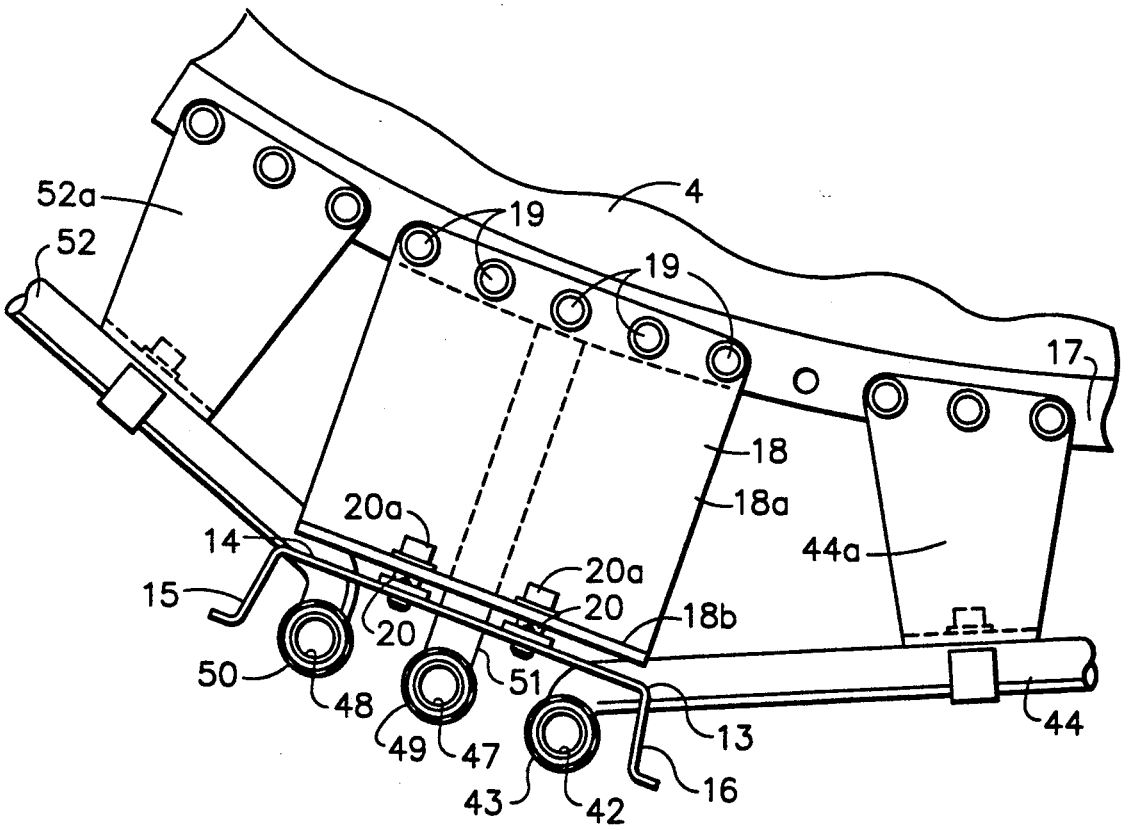
FIG. 6 is a fragmentary cross sectional view taken along section line 6—6 of FIG. 1.
Figure 7:
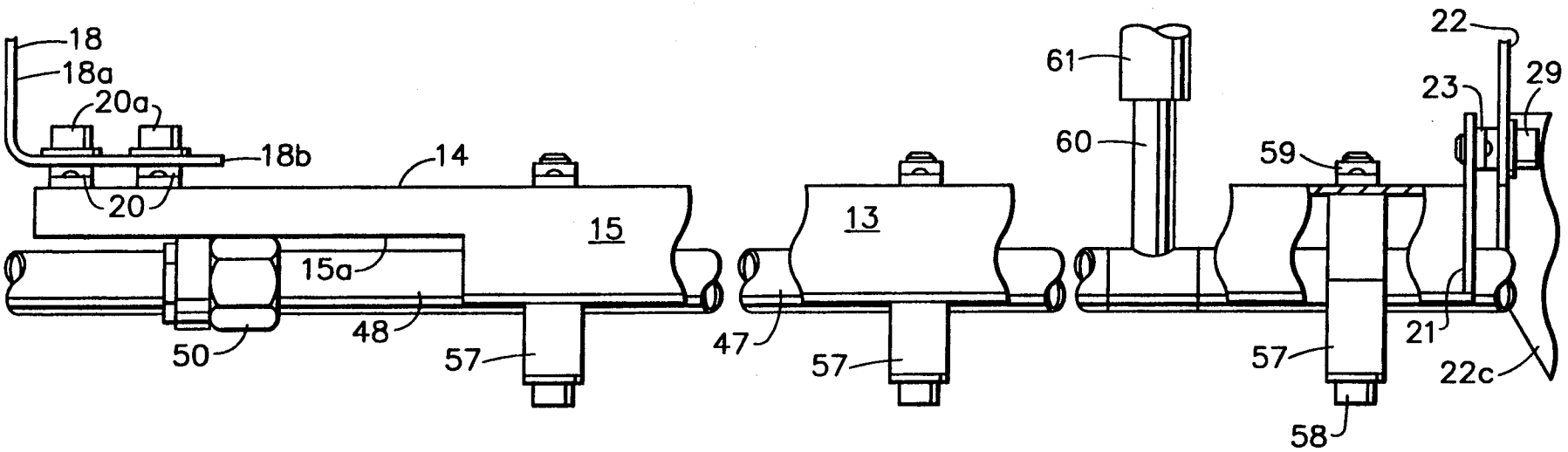
FIG. 7 is a fragmentary, longitudinal, elevational view, partly in cross section, of the tray of the present invention.

At its aft end, the tray 13 is rigidly attached to the aft flange 17 of the turbine section 4 by an aft angle bracket 18 (as shown in FIGS. 6 and 7). The upstanding leg 18*a* of aft angle bracket 18 is attached to the flange 17 by bolts 19. The support portion 14 of tray 13, near the aft end thereof, is provided with four nuts riveted in place. Three of these nuts are shown in FIGS. 6 and 7 at 20. The nuts 20 are engaged by flanged bolts 20*a* which pass through the outwardly extending leg 18*b* of aft angle bracket 18. In this way, the aft end of tray 13 is rigidly and removably attached to the engine 1.

Figure 3:
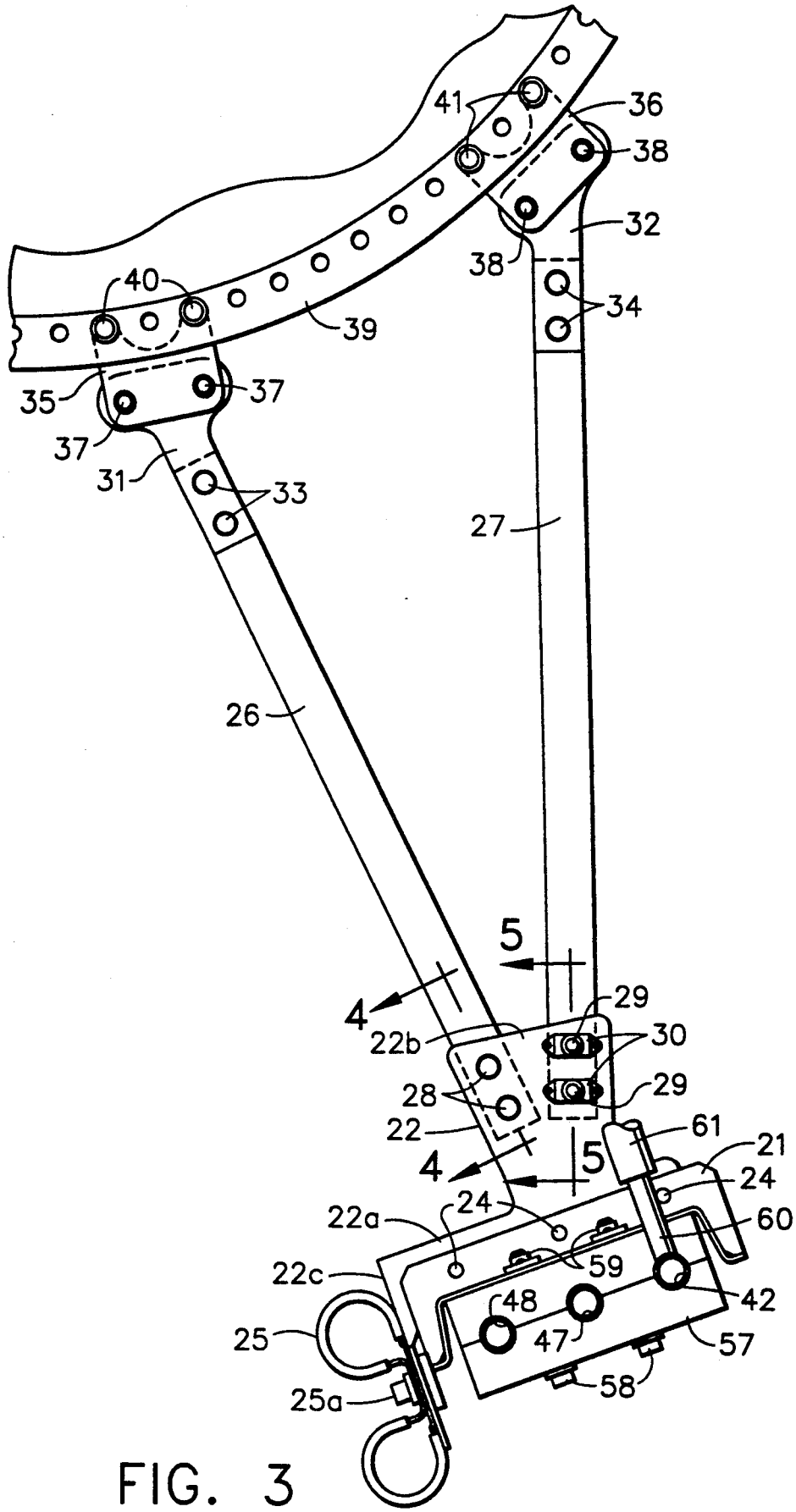
FIG. 3 is a fragmentary cross sectional view taken along section line 3—3 of FIG. 1.

At its forward end, the tray 13 has an external flange welded thereto. This flange is shown at 21 in FIGS. 3 and 7. A sheet metal forward tray bracket is indicated at 22, having a base portion 22*a* and an upstanding portion 22*b*. The external tray flange 21 is provided with three nuts riveted in place, one of which is shown at 23 in FIG. 7. The nuts 23 are threadedly engaged by flanged bolts 24, by which the forward tray bracket 22 is attached to the external forward tray flange 21. The forward tray bracket 22 has, on its base portion 22*a*, a forwardly bent flange portion 22*c*. This flange portion 22*c* supports a double hose bracket 25 bolted thereto as at 25*a*. The purpose of the double hose bracket 25 will be apparent hereinafter.

Figure 4:
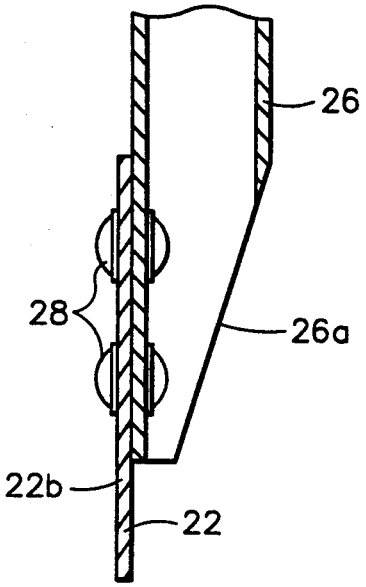
FIG. 4 is a cross sectional view taken along section line 4—4 of FIG. 3.
Figure 5:
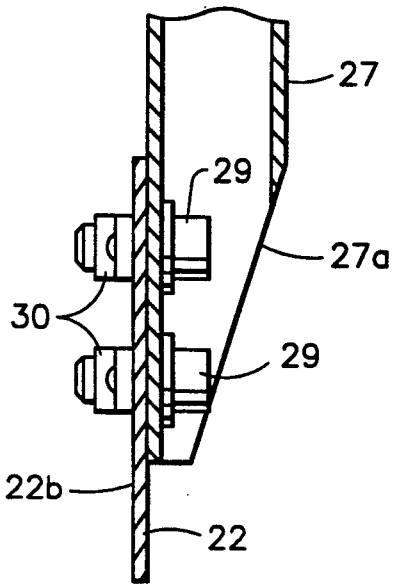
FIG. 5 is a fragmentary cross sectional view taken along section line 5—5 of FIG. 3.

The upstanding portion 22*b* of forward tray bracket 22 has a pair of elongated struts 26 and 27 affixed thereto. The struts 26 and 27 are tubular members having a rectangular cross section. At their lowermost ends, the struts 26 and 27 are relieved as at 26*a* and 27*a* in FIGS. 4 and 5, respectively. It will be understood that the upper ends of struts 26 and 27 will be similarly relieved.

At its lowermost end, the strut 26 is affixed to the upstanding portion 22*a* of forward tray bracket 22 by rivets 28. The lowermost end of strut 27 is affixed to the upstanding portion 22*b* of forward tray bracket 22 by bolts 29 engaged in riveted-on nuts 30 carried by upstanding portion 22*b*. The upper ends of struts 26 and 27 are riveted to sheet metal elements 31 and 32, respectively, as at 33 and 34. The sheet metal elements 31 and 32 are, in turn, bolted to forward flange brackets 35 and 36, as at 37 and 38. Finally, the forward flange brackets 35 and 36 are bolted to the aft flange 39 of compressor section 2, as at 40 and 41. The sheet metal forward tray bracket 22 at the lower end of struts 26 and 27 and the sheet metal elements 31 and 32 at the upper end of struts 26 and 27 are capable of flexing. This allows thermal expansion or growth of the tray assembly in the forward direction. The various struts, brackets and flanges may be made of any appropriate material such as stainless steel, or the like. The tray 13 is also made of stainless steel. The tray 13 is relatively simple and inexpensive to manufacture. All required perforations may be made before the tray walls are bent downwardly and outwardly.

Reference is now made to FIG. 2. The tray 13 carries a rectilinear supply line. The supply line 42 is connected at 43 to the supply tube 44 leading to sump of the rear bearing assembly 10. As shown in FIG. 6, the supply tube 44 is supported on flange 17 by bracket assemblies, one of which is shown at 44*a*. The forward end of line 42 is connected as at 45 to a flexible hose 46 leading to and connected to the output of the supply pump portion of the supply pump and scavenge pump assembly 11.

The tray 13 also carries rectilinear scavenge lines 47 and 48. Scavenge lines 47 and 48 are attached at 49 and 50 to scavenge tubes 51 and 52, respectively. Scavenge tubes 51 and 52 are respectively connected to the rear and forward halves of the sump constituting part of the rear bearing assembly 10. As sown in FIG. 6, scavenge tube 52 is supported on flange 17 by bracket assemblies, one of which is shown at 52*a*. The forward ends of scavenge lines 47 and 48 are connected at 53 and 54, respectively, to flexible scavenge hoses 55 and 56. Hoses 55 and 56, in turn, are connected to intake ports of the scavenge pump portion of the supply pump and scavenge pump assembly 11.

The lines 42, 47 and 48 are affixed to the tray 13 by a series of two-piece tube mounting elements 57. Each tube mounting element 57 is affixed to the tray by bolts 58 and fixed nuts 59. The lubrication and scavenge system for the rear bearing assembly 10 having been described, the lube and scavenge system for the center bearing assembly can next be set forth. The supply line 42 in tray 13 has, near its forward end, a T-fitting 60. A flexible supply hose 61 is connected to T-fitting 60 and to supply tube 62, as at 63. Supply tube 62 is connected to the sump constituting a part of central bearing assembly 9. A pair of flexible scavenge hoses 64 and 65 are connected respectively to scavenge tubes 66 and 67 at 68 and 69. Scavenge tube 66 is connected to the rear half and scavenge tube 67 is connected to the forward half of the sump constituting a part of central bearing assembly 9. The scavenge hoses 64 and 65 are connected to intakes of the scavenge pump portion of the supply pump and scavenge pump assembly 11. The scavenge hoses 64 and 65 are supported by the double hose bracket 25 of FIG. 3. The supply line 42 and the scavenge lines 47 and 48 may be made of any appropriate material including stainless steel. Similarly, the rear bearing assembly supply tube 44 and scavenge tubes 51 and 52, as well as the central bearing assembly supply tube 62 and scavenge tubes 66 and 67 may also be made of any appropriate material such as stainless steel or the like. The flexible hoses 46, 55, 56, 64 and 65 may be made of any appropriate material. Excellent results have been achieved using tetrafluoro ethylene manufactured by the E. I. DuPont de Nemours Company of Wilmington, Del., under the trademark TEFLON ®.

From the above description, it will be apparent that the off-engine tray routes outboard of other engines systems are independent and are not impacted by changes in other hardware. There are no routing conflicts. Thermal and dynamic properties are excellent and infinite life is expected. The lines in the tray are rectilinear and easy to make. The number of parts required for the lubrication and scavenge system of the present invention is far less than the number required for prior art on-engine lubrication and scavenge systems. The cost of the system of the present invention is far less than the cost of on-engine systems and both assembly and disassembly time is drastically reduced. As a consequence, field module removal and hot section removal cycle times are greatly reduced. The tray and the lines it supports can be removed by removing eight bolts and loosening seven connections. The system of the present invention is much more easily maintained. Thermal accommodation is provided by the flexible hoses and the forward tray mounting. Finally, standard hardware and materials may be used.

Modifications may be made in the invention without departing from the spirit of it.

I claim:

1. An off-engine circulatory lubrication supply and return system for the center and rear bearing assemblies of marine and industrial gas turbine engines, each of said center and rear bearing assemblies having supply and scavenge tubes leading therefrom and terminating in free ends exteriorly of the engine, said engine having a supply pump to supply lubricant to said bearing assemblies and a scavenge pump to scavenge lubricant from said bearing assemblies, supply lines connecting said supply pump to said free ends of said bearing assembly supply tubes and scavenge lines connecting said scavenge pump to said free ends of said bearing assembly scavenge tubes, and a tray assembly extending longitudinally along said gas turbine engine, said tray assembly comprising an elongated rigid tray and mounting means therefor, said tray being supported and spaced from said gas turbine engine by said mounting means affixed to said engine, said supply and scavenge lines for said rear bearing assembly having portions mounted on and supported off-engine by said tray, and said supply and scavenge lines for said center bearing assembly being held off-engine by said tray assembly.

2. The lubrication system claimed in claim 1 wherein said supply and scavenge lines for said rear bearing assembly comprise rigid, rectilinear, metallic line portions having forward and aft ends, said supply and scavenge lines for said rear bearing assembly further comprising flexible hose sections connected to said forward ends of said metallic line portions and terminating in free ends, said free ends of said supply and scavenge line hose sections being connected to said supply and scavenge pumps respectively, said metallic line portions extending substantially the length of said tray and being mounted thereon, the aft ends of said supply and scavenge metallic line portions being removably connected to said supply and scavenge tubes of said rear bearing assembly.

3. The lubrication system claimed in claim 1 wherein there is one supply line and two scavenge lines for each of said center and rear bearing assemblies, each of said center and rear bearing assemblies having one supply tube and two scavenge tubes.

4. The lubrication system claimed in claim 1 wherein said tray has forward and aft ends and said gas turbine engine has a compressor section, a combustor section and a turbine section, said mounting means for said tray comprising a rigid aft bracket removably affixed to an aft end of said turbine section and to said aft end of said tray and a forward support assembly removably affixed to an aft end of said compressor section and said forward end of said tray, said forward support assembly being capable of flexing thereby permitting forward thermal expansion of said tray and said lines mounted thereon.

5. The lubrication system claimed in claim 2 wherein said supply and scavenge lines for said center bearing assembly comprise flexible hoses.

6. The lubrication system claimed in claim 5 wherein there is one supply line and two scavenge lines for each of said center and rear bearing assemblies, each of said center and rear bearing assemblies having a pair of scavenge tubes and a single supply tube, said scavenge lines for said center bearing assembly being supported by a double hose bracket affixed to said tray, said supply line for said rear bearing assembly having a T-fitting extending through said tray, said supply line for said center bearing assembly being connected between said supply tube of said center bearing assembly and said T-fitting.

7. The lubrication system claimed in claim 6 wherein said tray has a forward end and an aft end and said gas turbine engine has a compressor section, a combustor section and a turbine section, said mounting means for said tray comprising a rigid aft bracket removably affixed to an aft end of said turbine section and to said aft end of said tray and a forward support assembly removably affixed to an aft end of said compressor section and said forward end of said tray, said forward support assembly being capable of flexing thereby permitting forward thermal expansion of said tray and said lines mounted thereon.

* * * * *